US009680194B2

(12) United States Patent
Chong et al.

(10) Patent No.: US 9,680,194 B2
(45) Date of Patent: Jun. 13, 2017

(54) ORTHOMODE TRANSDUCERS AND METHODS OF FABRICATING ORTHOMODE TRANSDUCERS

(71) Applicant: Radio Frequency Systems, Inc., Meriden, CT (US)

(72) Inventors: Yin-Shing Chong, Middletown, CT (US); Peter Casey, Clinton, CT (US); Yunchi Zhang, Wallingford, CT (US)

(73) Assignee: Alcatel-Lucent Shanghai Bell Co., Ltd, Shanghai (CN)

( * ) Notice: Subject to any disclaimer, the term of this patent is extended or adjusted under 35 U.S.C. 154(b) by 254 days.

(21) Appl. No.: 13/908,542

(22) Filed: Jun. 3, 2013

(65) Prior Publication Data

US 2014/0354375 A1 Dec. 4, 2014

(51) Int. Cl.
*H01P 5/12* (2006.01)
*H01P 1/161* (2006.01)
*H01P 11/00* (2006.01)

(52) U.S. Cl.
CPC ..... *H01P 1/161* (2013.01); *H01P 11/001* (2013.01); *H01P 11/002* (2013.01)

(58) Field of Classification Search
CPC .... H01P 1/161; H01P 5/12; H01P 1/16; H01P 5/04; H01P 1/165
USPC ..... 333/100, 108, 113–114, 122, 126, 333/135–137
See application file for complete search history.

(56) References Cited

U.S. PATENT DOCUMENTS

| | | | | |
|---|---|---|---|---|
| 5,380,386 | A * | 1/1995 | Oldham et al. | 156/150 |
| 5,464,394 | A * | 11/1995 | Miller | A61M 25/005 604/103.1 |
| 6,556,807 | B1 * | 4/2003 | Horie et al. | 455/3.02 |
| 6,842,085 | B2 * | 1/2005 | Chen et al. | 333/125 |
| 2003/0076193 | A1 * | 4/2003 | Chen et al. | 333/126 |
| 2010/0141543 | A1 | 6/2010 | Parekh et al. | |
| 2011/0037534 | A1 | 2/2011 | Espino et al. | |
| 2011/0243562 | A1 | 10/2011 | Jackson et al. | |
| 2012/0032867 | A1 * | 2/2012 | Fonseca | 343/850 |
| 2014/0240197 | A1 | 8/2014 | Chong et al. | |

* cited by examiner

*Primary Examiner* — Lincoln Donovan
*Assistant Examiner* — Diana J Cheng
(74) *Attorney, Agent, or Firm* — Capitol Patent & Trademark Law Firm, PLLC

(57) ABSTRACT

Orthomode transducers (OMTs) and methods of fabricating OMTs are disclosed. According to disclosed embodiments, an OMT includes a housing defining an internal waveguide. The housing may be composed of a first cast housing member attached to a second cast housing member. The first housing member may include a first side of the waveguide that is cast into the first housing member. The second housing member may include a second side of the waveguide that is cast into the second housing member. A method of fabricating an OMT may include arranging at least one casting insert in at least one mold, casting the housing in the mold and casting a waveguide in the housing using the at least one casting insert. The disclosed devices and methods provide cost effective solutions for fabricating OMTs of various operating frequencies that share a substantially similar outer housing shape and size.

12 Claims, 9 Drawing Sheets

*FIG. 1*
(CONVENTIONAL)
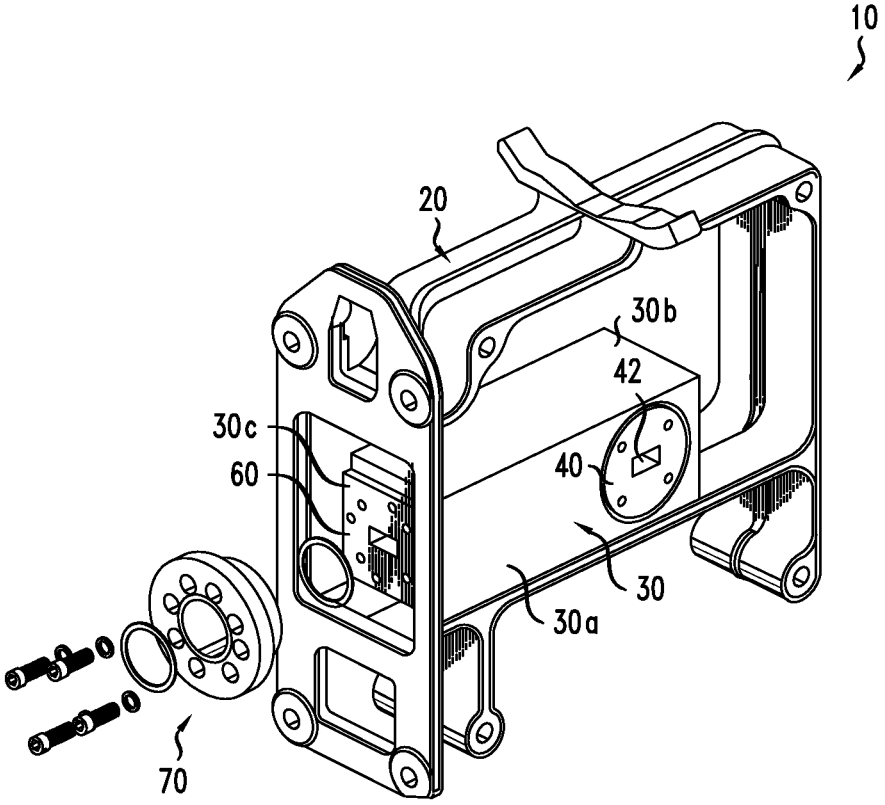

ORTHOMODE TRANSDUCERS AND METHODS OF FABRICATING ORTHOMODE TRANSDUCERS

BACKGROUND OF THE INVENTION

As known to those in the art of microwave radio communications, an orthomode transducer (OMT) is a three-port device which can be used to separate and/or combine orthogonally polarized signals. The OMT is often used to receive signals of a first polarization and transmit signals of a second polarization. The OMT includes a housing that defines a waveguide including a first waveguide branch, a second waveguide branch coupled to the first waveguide branch, and a third waveguide branch coupled to the first and second waveguide branches. The first waveguide branch is configured to enable propagation of a signal having the first polarization. The second waveguide branch is configured to enable propagation of a signal having the second polarization. The third waveguide branch is configured to enable propagation of a signal having either the first polarization or the second polarization.

Microwave radio communication systems can operate over a wide range of frequencies (from 5 GHz to 80 GHz, for example). It is therefore necessary to provide OMTs that operate over many different frequencies. Because the size and/or configuration (e.g., shape) of the waveguide in an OMT varies with frequency, traditionally, several OMTs with differently sized waveguides need to be provided to cover all of the frequencies required for certain applications.

FIG. 1 shows a conventional OMT assembly 10. The assembly 10 includes a frame 20 and an OMT 30 secured to the frame 10. The OMT 30 is constructed of a machined block of material, such as aluminum or magnesium, and defines an internal waveguide (not shown). The OMT 30 includes a first port 40 including a first waveguide aperture 42 in a first side 30*a* of the OMT 30, a second port including a second waveguide aperture (not shown) in a second side 30*b* of the OMT 30 opposite the first side 30*a*, and a third port 60 including a third waveguide aperture 62 located at an end 30*c* of the OMT30. The first waveguide aperture 42 is located at an external end of a first waveguide branch (not shown) configured to enable propagation of a signal having a first polarization. The second waveguide aperture (not shown) is located at an external end of a second waveguide branch (not shown) configured to enable propagation of a signal having a second polarization. The third waveguide aperture 62 is located at an external end of a third waveguide branch (not shown) configured to enable propagation of a signal having either the first polarization or the second polarization.

Still referring to FIG. 1, radios (not shown) can be attached to first port 40 and the second port (not shown) to place the radios in communication with the first waveguide aperture 42 and the second waveguide aperture (not shown), respectively. A feed element mounting assembly 70 can be attached to the third port 60 to place a feed element or feed horn (not shown) in communication with the third waveguide aperture 62.

The assembly 10 is relatively expensive to manufacture, as it employs two parts (the frame 20 and the OMT 30), and machining of the OMT 30 (particularly, the waveguide) is expensive. Additionally, the assembly 10 is customer/application specific and, therefore, the frame 20 must be configured differently for each customer/application.

In view of the above, it is desirable to provide cost-effective methods of manufacturing OMTs having a wide range of operating frequencies. It is further desirable to provide OMTs that have a substantially consistent outer housing shape and size regardless of operating frequency.

SUMMARY OF THE INVENTION

The disclosure relates to orthomode transducers (OMTs) for microwave radio antennas, and methods of fabricating OMTs. According to an embodiment of the invention, an OMT may include a cast housing and a cast waveguide in the housing. The cast waveguide may include: a first waveguide branch coupled to a first waveguide aperture and configured to support transmission of signals having a first polarization; a second waveguide branch coupled to a second waveguide aperture and configured to support transmission of signals having a second polarization opposite the first polarization; and a third waveguide branch coupled to a third waveguide aperture, the first waveguide branch and the second waveguide branch, wherein the third waveguide branch is configured to support transmission of signals having the first polarization and signals having the second polarization.

According to another embodiment, a method of fabricating an OMT includes arranging at least one casting insert in at least one mold, casting a housing in the at least one mold, and casting a waveguide in the housing using the at least one casting insert.

The OMTs and methods of manufacturing OMTs disclosed herein provide cost-effective and efficient solutions for providing OMTs having different waveguide configurations, but having housings of substantially uniform size and shape. Additional features and advantages will be apparent to those of ordinary skill in the art in view of the following detailed description and appended drawings.

BRIEF DESCRIPTION OF THE DRAWINGS

FIG. 1 is a perspective view of a conventional orthomode transducer (OMT) assembly.

DETAILED DESCRIPTION OF THE INVENTION

The following description discloses novel orthomode transducers (OMTs) and novel methods of fabricating OMTs. The OMTs described herein are suitable for use in microwave radio communication devices, such as a very small aperture terminal (VSAT) antennas for satellite communications and terrestrial microwave radio antennas, for example. The OMTs disclosed herein may be configured to receive signals of a first polarization and transmit signals of a second polarization orthogonal to the first polarization. Alternatively, the OMTs may be configured to transmit signals of first and second polarizations or receive signals of first and second polarizations.

In the following description and associated drawings, reference numbers and characters repeated between the various embodiments indicate similar components and features. Throughout the description, reference is made to various directions, such as "horizontal", "horizontally", "vertical", "vertically", "diagonal" and "diagonally." These terms are used to reference directions relative to an OMT in a typical position for use. However, it should be understood that such directional terms are relative terms used to facilitate understanding of the devices as shown in the appended drawings, and are not intended to be limiting. Further, the use of the word "includes" in the following description is meant to be non-limiting. When the word "includes" is used to describe the inclusion of a component or feature, it should be understood that the specific component described is non-limiting, and there may be other equivalent components or features that fall within the scope of the invention. Alternatively, the inclusion of the component may be optional. It may be appropriate to interpret the word "includes" as meaning "may include," depending on the context of the discussion.

It should be further understood that, although the terms first, second, third, etc. may be used herein to describe various elements, the elements should not be limited by these terms. Such terms are used to distinguish one element from another. For example, a first element could be termed a second element, and, similarly, a second element could be termed a first element, without departing from the scope of disclosed embodiments. It should be understood that when an element is referred to as being "connected", "coupled" or "attached" to another element, it may be directly connected, coupled or attached to the other element, or intervening elements may be present, unless otherwise specified. Additional words used to describe connective or spatial relationships between elements or components (e.g., "between") should be interpreted in a like fashion.

Figure 2:
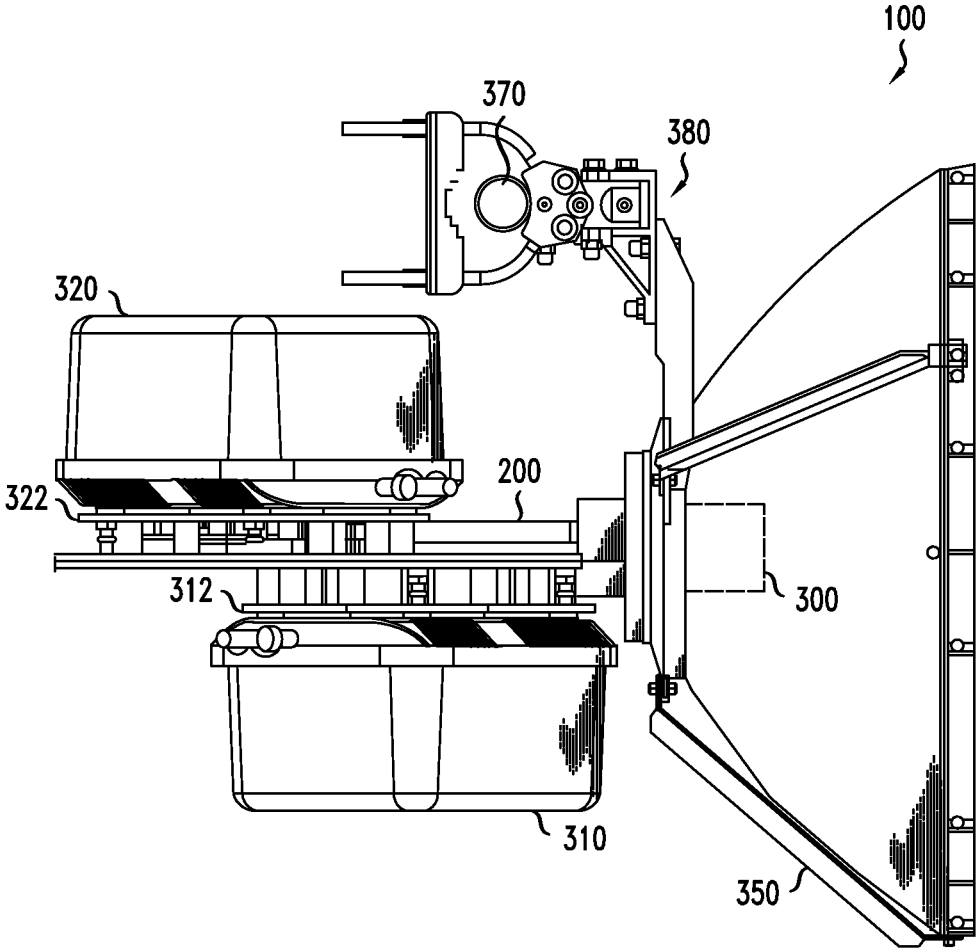
FIG. 2 shows an antenna including an orthomode transducer (OMT), according to an embodiment of the invention.

Turning now to the figures, FIG. 2 depicts an exemplary antenna 100 for a communication system according to an embodiment of the invention. The antenna 100 may be, for example, a very small aperture terminal (VSAT) antenna or a terrestrial microwave radio antenna, operating over the range of 6 to 80 gigahertz. However, it should be understood that the antenna 100 may operate over other frequency ranges.

As shown in FIG. 2, the antenna 100 may include an orthomode transducer (OMT) 200, a feed element 300 (e.g., feed horn) attached to and in communication with the OMT 200, a first radio 310 attached to the OMT 200, a second radio 320 attached to the OMT 200, and a reflector 350 configured to reflect signals to and from the feed element 300. Additional waveguide elements, such as a circular polarizer (not shown) may be attached between the OMT 200 and the feed element 300, depending on the application.

According to an embodiment, the first radio 310 may be a receiver and the second radio 320 may be a transmitter, or vice-versa. According other embodiments, both radios 310, 320 may be transmitters or both radios 310, 320 may be receivers.

As shown in FIG. 2, the antenna 100 may be mounted on a pole 370 via a mounting bracket 380 attached to the reflector 350 and/or the OMT 200. However, other mounting arrangements are possible.

Figure 3:
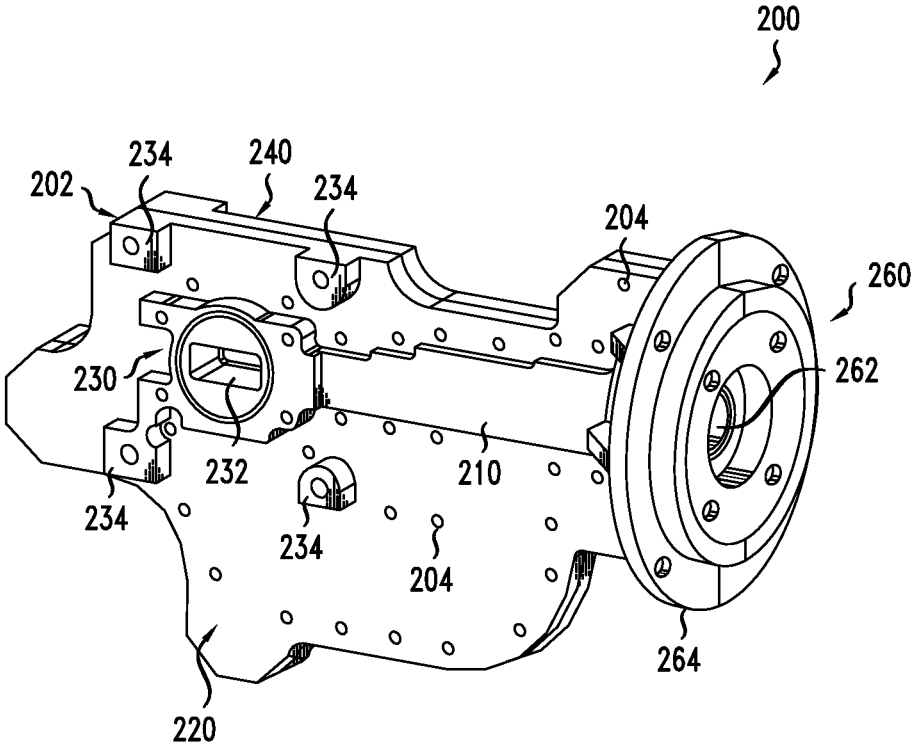
FIG. 3 is an exterior perspective view of the OMT of FIG. 2.
Figure 4:
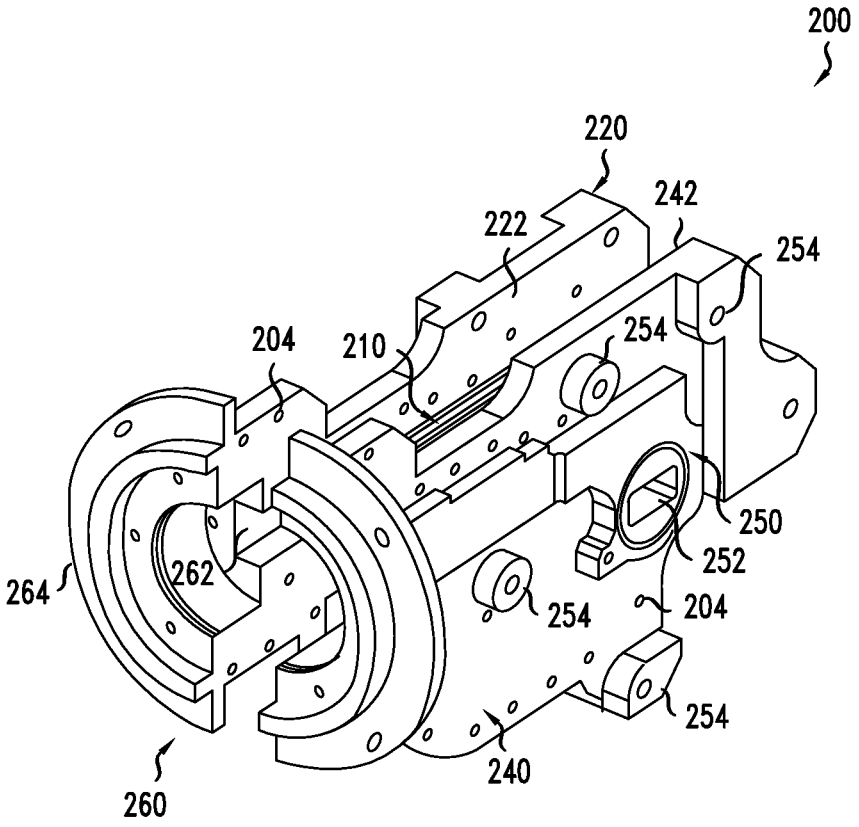
FIG. 4 is an exploded, exterior perspective view of the OMT of FIG. 2, generally opposite the view of FIG. 3.

Referring now to FIGS. 3 and 4, the OMT 200 includes a housing 202 that defines an electrically conductive waveguide 210 within its interior. The housing 202 is composed of a first housing member or portion 220 and a second housing member or portion 240. The first housing member 220 and the second housing member 240 may be of similar shape and size, and may each form approximately one half of the housing 202. When the OMT 200 is in an assembled configuration (FIG. 3), the housing members 220, 240 are attached to each other at their respective inner surfaces 222, 242 (FIG. 4) and may be secured together by fasteners (not shown) received in holes 204. In addition to or in place of being secured together by fasteners, the housing members 220, 240 may be secured together by adhesive or welds. The housing members 220, 240 may be castings constructed of aluminum, magnesium, plastic, a polymer or another suitably strong material.

Referring to FIG. 3, the housing 202 may include a first port 230 located on the first housing member 220 and having a first waveguide aperture 232 formed therein. The first waveguide aperture 232 may be configured to communicate with the first radio 310 and may be configured, for example, to support the transmission of signals having a first polarization (e.g., horizontal). Bosses 234 may be included on or near the first port 230 for interfacing with a mounting ring or mounting member 312 (FIG. 2) that attaches the first radio 310 to the first housing member 220.

As shown in FIG. 4, the housing 202 may include a second port 250 located on the second housing member 240 and having a second waveguide aperture 252 formed therein. The second waveguide aperture 252 may be configured to communicate with the second radio 320 and may be configured, for example, to support the transmission of signals having a second polarization (e.g., vertical) orthogonal to the first polarization. Bosses 254 may be included on or near the second port 250 for interfacing with a mounting ring or mounting member 322 (FIG. 2) that attaches the second radio 320 to the second housing member 240.

Referring to FIGS. 3 and 4, the housing 202 may include a third, common port 260 having a third waveguide aperture 262 formed therein. The third port 260 may be located on the first and second housing members 220, 240 such that each housing member 220, 240 forms half or approximately half of the third port 260 and the third waveguide aperture 262. The third waveguide aperture 262 may be configured to communicate with the feed element 300 and may be configured, for example, to support the transmission of signals having the first polarization and signals having the second polarization. A flange 264 may be included on the third port 260 for attaching the feed element 300 and the reflector 350 to the housing 202.

As illustrated in FIGS. 3 and 4, the first and second ports 230, 250 are located on horizontally opposed sides of the housing 202 and such that their surfaces may be substantially parallel to each other, thereby positioning the first and second waveguide apertures 232, 252 in side-by-side orientation. Accordingly, the first waveguide aperture 232 lies in a plane that is parallel to the plane in which the second waveguide aperture 252 lies. The surface of the third port 260 may be orthogonal or substantially orthogonal to the surfaces of the first and second ports 230, 250, such that the third waveguide aperture 262 lies in a plane that is orthogonal or substantially orthogonal to the planes in which the first and second waveguide apertures lie.

Still referring to FIGS. 3 and 4, the first and second waveguide apertures 232, 252 are illustrated as being rectangular-shaped and having similar orientations, and the third waveguide aperture 262 is illustrated as being square-shaped. It is noted that the similar orientations of the first and second waveguide ports 232, 252 illustrated in FIGS. 3 and 4 are possible because the waveguide branch 214 (FIG. 5) coupled to the second waveguide aperture 252 is twisted within the housing 202. It should be understood that it is possible for the waveguide apertures 232, 252, 262 and the waveguide 210 to have shapes and orientations other than those specifically illustrated and described herein.

Figure 5:
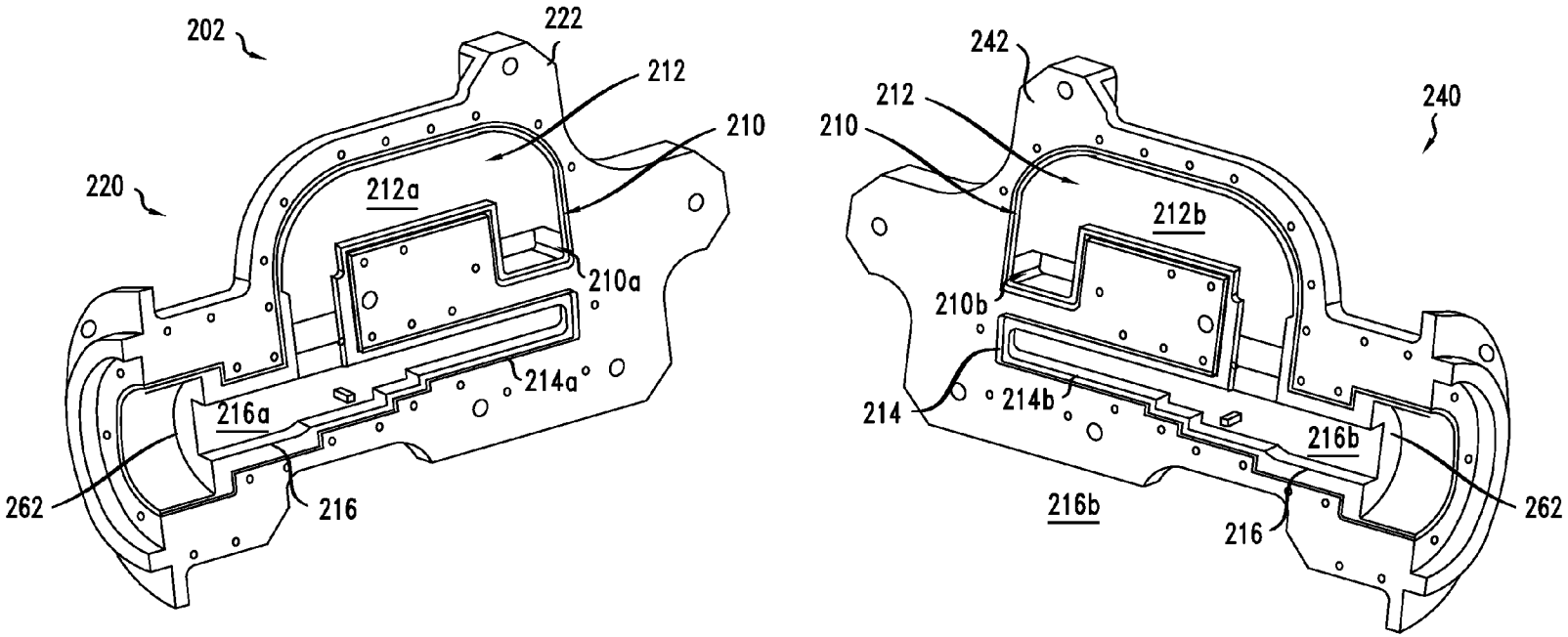
FIG. 5 is an exploded, interior perspective view of the OMT of FIG. 2.

FIG. 5 is an exploded, interior view of the housing 202 showing the waveguide 210 in detail. The waveguide 210 may be a cast pathway composed of pathway portions that are integrally cast with the housing members 220, 240. In embodiments in which the housing members 220, 240 are constructed of a material that is not electrically conductive, the surfaces of the waveguide 210 may be coated with an electrically conductive material.

As shown in FIG. 5, the waveguide 210 may include a first waveguide branch 212 coupled to the first waveguide aperture 232 and configured for transmission of signals of the first polarization, a second waveguide branch 214 coupled to the second waveguide aperture 252 and configured for transmission of signals of the second polarization, and a third, common waveguide branch 216 coupled to first and second waveguide branches 212, 214 and the third waveguide aperture 262, and configured for transmission of signals of the first polarization and the second polarization. The first waveguide branch 212 may have an inverted "U" shape and may be orthogonal to the third waveguide branch 216 where it intersects the third waveguide branch 216. The second waveguide branch 214 may be substantially coaxial with the third waveguide branch 216, and may be vertically spaced from the first waveguide branch 212.

As can be seen in FIG. 5, the first housing member 220 includes a first side 210*a* of the waveguide 210 and the second housing member 240 includes a second side 210*b* of the waveguide 210. The first side 210*a* of the waveguide 210 includes first sides 212*a*, 214*a*, 216*a* of the waveguide branches 212, 214, 216. The second side 210*b* of the waveguide 210 includes second sides 212*b*, 214*b*, 216*b* of the waveguide branches 212, 214, 216. When the first and second housing members 220, 240 are attached to each other to form the complete housing 202, the first and second sides 210*a*, 210*b* of the waveguide 210 are aligned with each other such that the first sides 212*a*, 214*a*, 216*a* of the waveguide branches 212, 214, 216 are aligned the second sides 212*b*, 214*b*, 216*b* of the waveguide branches 212, 214, 216. Thus, the first and second sides 210*a*, 210*b* of the waveguide 210 interface with each other to form the waveguide 210.

In order to improve fabrication efficiency and reduce fabrication costs, the OMT 200 may be fabricated by a method including casting the housing 202. According to an exemplary method, the first housing member 220 may be cast in a first mold and the second housing member 240 may be cast in a second mold. Alternatively, the first and second housing members 220, 240 may be cast in the same mold. The first and second sides 210*a*, 210*b* of the waveguide 210 may be cast in the housing members 220, 240, respectively, by arranging one or more casting inserts in the mold(s). The one or more casting inserts may be arranged, sized and shaped as desired to produce the desired arrangement, size and shape of the first and second sides 210*a*, 210*b* of the waveguide 210. Thus, the operating frequency of OMTs 200 can be varied by simply using different casting inserts, while using the same housing mold(s). If the sides 210*a*, 210*b* of the waveguide 210 are cast from a non-conductive material, they may be coated with a conductive material after casting. After casting the housing members 220, 240, the housing members 220, 240 may be attached to each other such that the first and second sides 210*a*, 210*b* of the waveguide 210 are aligned with each other and interface with each other to form the waveguide 210.

Figure 6:
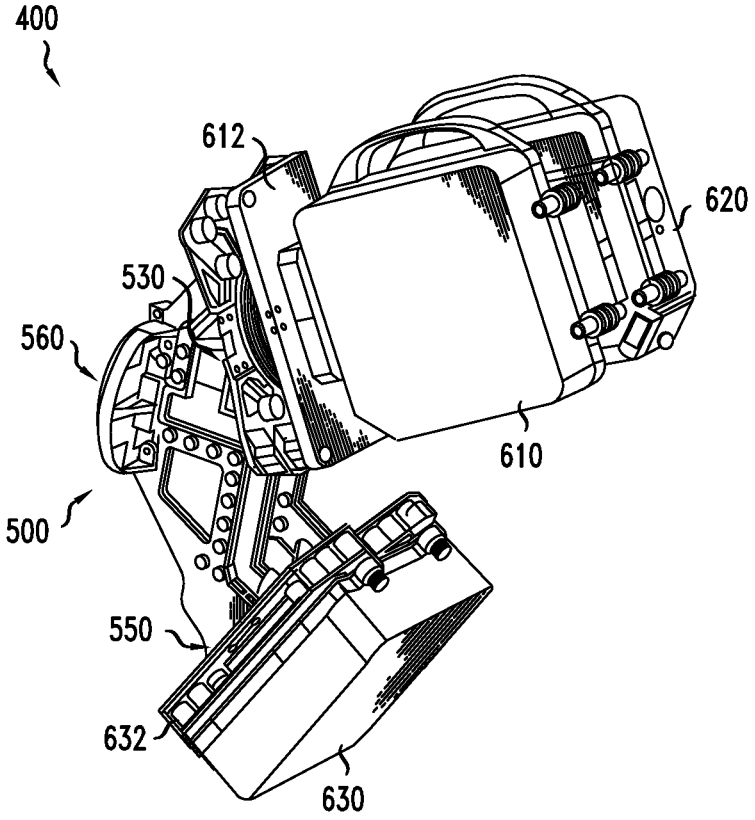
FIG. 6 shows an antenna sub-assembly including an OMT, according to another embodiment of the invention.

FIG. 6 shows an exemplary antenna sub-assembly 400 for a communication system according to another embodiment. The sub-assembly antenna 400 may be used in, for example, a very small aperture terminal (VSAT) antenna or a terrestrial microwave radio antenna, operating over the range of 6 to 80 gigahertz. However, the sub-assembly 400 may be used in antennas operating in other frequency ranges. As shown in FIG. 6, the sub-assembly 400 may include an OMT 500 and first, second and third radios 610, 620, 630 attached to and in communication with the OMT 500. When used in an antenna, the OMT 500 may be connected to a feed element (not shown) and a reflector (not shown) similar to those illustrated in FIG. 1.

According to an exemplary embodiment, the first and second radios 610, 620 may be receivers and the third radio 630 may be a transmitter, or vice-versa. According other embodiments, all three radios 610, 620, 630 may be receivers or all three radios 610, 620, 630 may be transmitters. The OMT 500 may be configured to receive signals of a first polarization and transmit signals of a second polarization orthogonal to the first polarization. Alternatively, the OMT 500 may be configured to transmit signals of the first and second polarizations or receive signals of the first and second polarizations.

Figure 7:
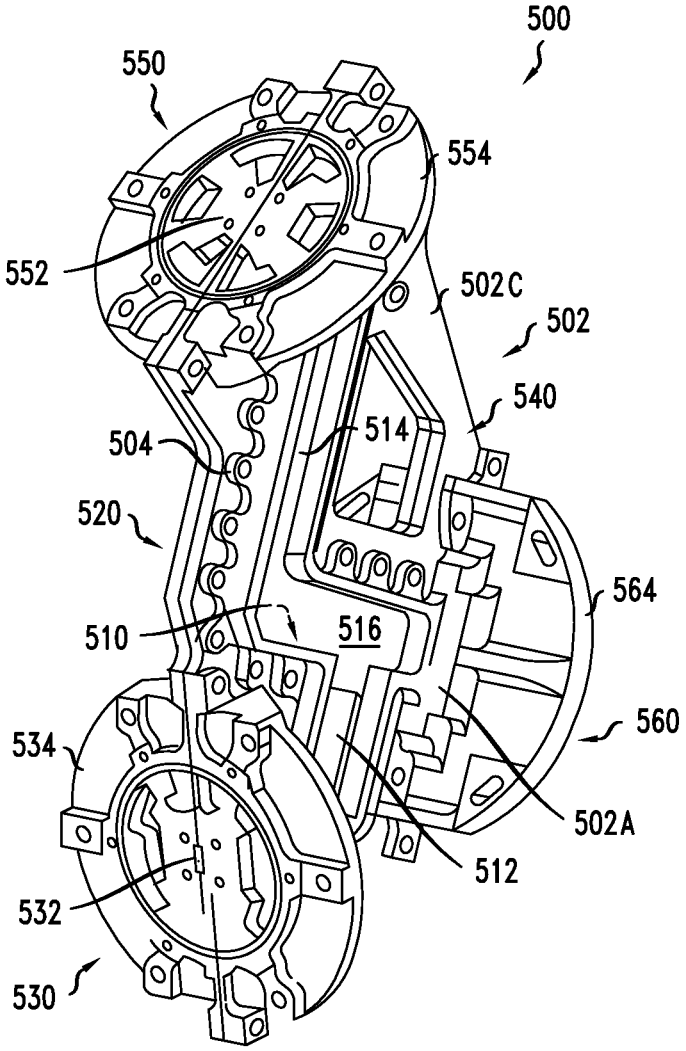
FIGS. 7 and 8 are exterior perspective views of the OMT of FIG. 6.
Figure 8:
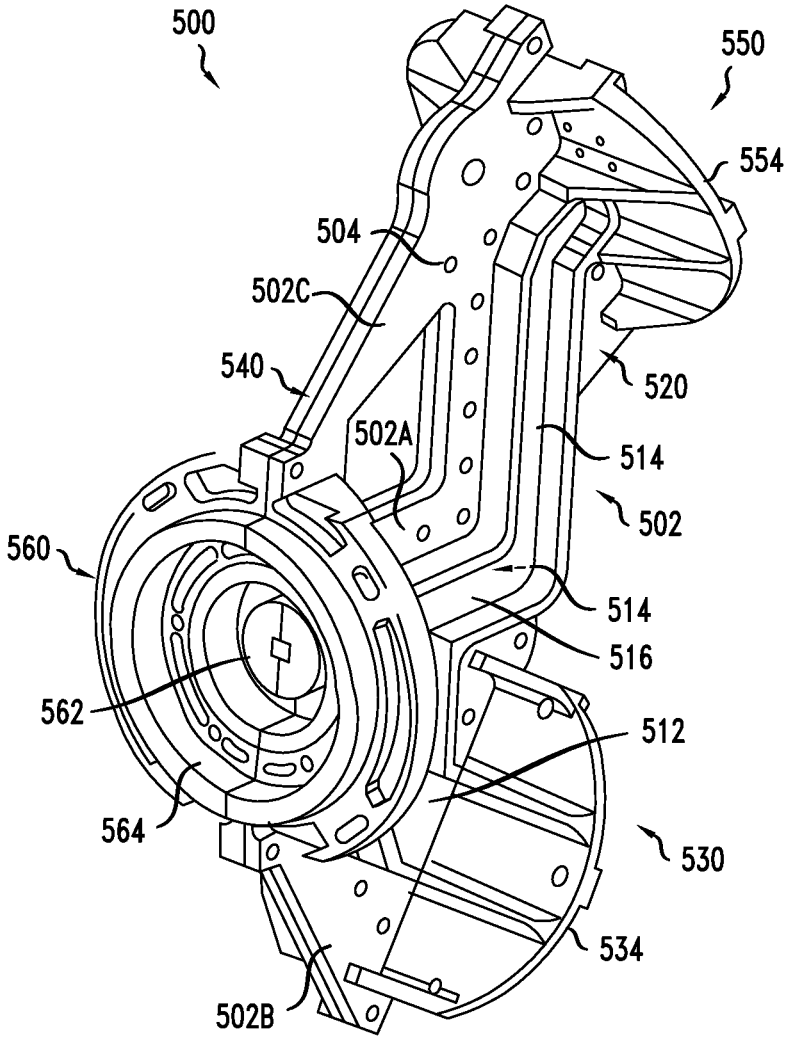

Turning to FIGS. 7 and 8, the OMT 500 includes a housing 502 that defines an electrically conductive waveguide 510 within its interior. The housing 502 is composed of a first housing member or portion 520 and a second housing member or portion 540. The first housing member 520 and the second housing member 540 may each have a similar shape and size, and they may each form approximately one half of the housing 502. When the OMT 500 is in an assembled configuration as shown in FIGS. 7 and 8, the housing members 520, 540 are attached to each other at their respective inner surfaces 522, 542 (FIG. 9) and may be secured together by fasteners (not shown) received in holes 504. The housing members 220, 240 may be secured together by adhesive or welds, in addition to or in place of being secured together by fasteners. The housing members 520, 540 may be castings constructed of aluminum, magnesium, plastic, a polymer or another suitably strong material.

As illustrated in FIG. 7, the housing 502 may include a first port 530 formed by the first and second housing members 520, 540 and having a first waveguide aperture 532 formed therein. Each housing member 520, 540 may form half or approximately half of the first port 530 and first waveguide aperture 532. The first waveguide aperture 532 may be configured to communicate with the first and second radios 610, 620 and may be configured, for example, to support the transmission of signals having a first polarization (e.g., horizontal). A flange 534 may be included on the first port 530 for interfacing with a mounting ring or mounting member 612 (FIG. 6) that attaches the first and second radios 610, 620 to the first and second housing members 520, 540.

Still referring to FIG. 7, the housing 502 may include a second port 550 formed by the first and second housing members 520, 540 and having a second waveguide aperture 552 formed therein. Each housing member 520, 540 may form half or approximately half of the second port 550 and second waveguide aperture 552. The second waveguide aperture 552 may be configured to communicate with the third radio 630 and may be configured, for example, to support the transmission of signals having a second polarization (e.g., vertical) orthogonal to the first polarization. A flange 554 may be included on the second port 550 for interfacing with a mounting ring or mounting member 632 (FIG. 6) that attaches the third radio 630 to the first and second housing members 520, 540.

Turning to FIG. 8, the housing 502 may include a third, common port 560 formed by the first and second housing members 520, 540 and having a third waveguide aperture 562 formed therein. Each housing member 520, 540 may form half or approximately half of the third port 560 and third waveguide aperture 562. The third waveguide aperture 562 may be configured to communicate with a feed element (not shown) and may be configured, for example, to support the transmission of signals having the first polarization and signals having the second polarization. A flange 564 may be included on the third port 560 for attaching a feed element and a reflector (not shown) to the housing 502.

The first and second waveguide apertures 532, 552 are illustrated in FIGS. 7 and 8 as being rectangular-shaped and having generally opposite orientations, and the third waveguide aperture 562 is illustrated as being square-shaped. It should be understood, however, that it is possible for the waveguide apertures 532, 552, 562 and the waveguide 510 to have shapes and orientations other than those specifically illustrated and described herein.

Referring to FIGS. 7 and 8, the housing 502 may include a center section 502*a* including the third port 550, a first arm 502*b* including the first port 530 and extending in a first diagonal direction from the center section 502*a* and, and a second arm 502*c* including the second port 550 and extending in a second diagonal direction from the center section 502*a*, substantially opposite the first diagonal direction. Thus, the housing 502 may be characterized as a substantially V-shaped or substantially U-shaped member. The first port 530 may lie within a plane that is transverse to the plane in which the second port 550 lies, and the third port 560 may lie within a plane that is transverse to the planes in which the first and second ports 530, 550 lie. Accordingly, the first waveguide aperture 532 may lie within a plane that is transverse to the plane in which the second waveguide aperture 552 lies, and the third waveguide aperture 562 may lie within a plane that is transverse to the planes in which the first and second waveguide apertures 532, 552 lie.

As illustrated in FIG. 7, the waveguide may include a first waveguide branch 512 coupled to the first waveguide aperture 532 and configured for transmission of signals of the first polarization, a second waveguide branch 514 coupled to the second waveguide aperture 552 and configured for transmission of signals of the second polarization, and a third, common waveguide branch 516 coupled to first and second waveguide branches 512, 514 and the third waveguide aperture 562, and configured for transmission of signals of the first polarization and the second polarization. The first waveguide branch 512 may be substantially V-shaped and may be orthogonal to the third waveguide branch 516 where it intersects the third waveguide branch 516. The second waveguide branch 514 may be substantially L-shaped with a portion that is substantially coaxial with the third waveguide branch 516 at the intersection of the second waveguide branch 514 and the third waveguide branch 516.

Figure 9:
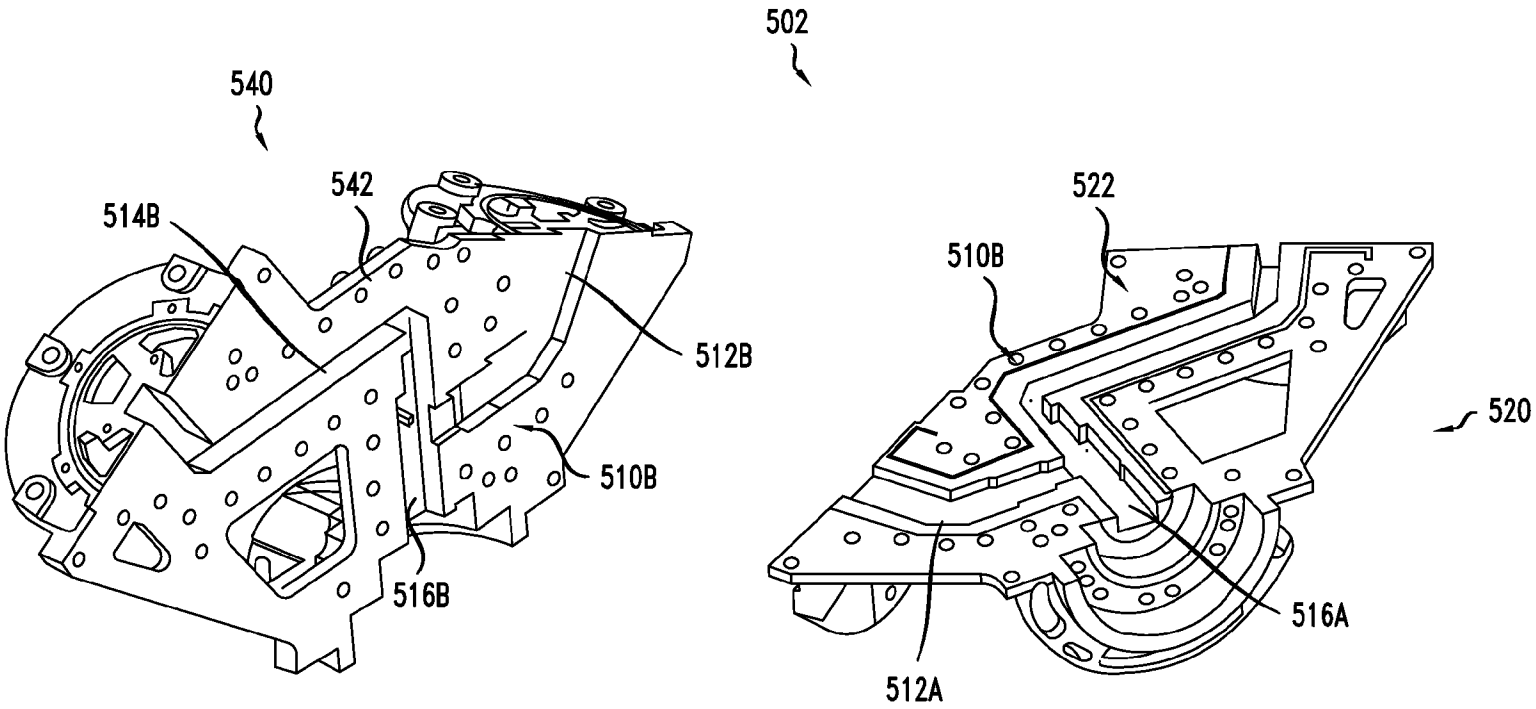
FIG. 9 is an exploded, interior perspective view of the OMT of FIG. 6.

FIG. 9 is an exploded, interior view of the housing 502 showing the waveguide 510 in detail. The waveguide 210 may be a cast pathway composed of pathway portions that are integrally cast with the housing members 520, 540. In embodiments in which the housing members 520, 540 are constructed of a material that is not electrically conductive, the surfaces of the waveguide 510 may be coated with an electrically conductive material.

Referencing FIG. 9, the first housing member 520 includes a first side 510*a* of the waveguide 510 and the second housing member 540 includes a second side 510*b* of the waveguide 510. The first side 510*a* of the waveguide 510 includes first sides 512*a*, 514*a*, 516*a* of the waveguide branches 512, 514, 516. The second side 510*b* of the waveguide 510 includes second sides 512*b*, 514*b*, 516*b* of the waveguide branches 512, 514, 516. When the first and second housing members 520, 540 are attached to each other to form the complete housing 502, the first and second sides 510*a*, 510*b* of the waveguide 510 are aligned with each other such that the first sides 512*a*, 514*a*, 516*a* of the waveguide branches 512, 514, 516 are aligned with the second sides 512*b*, 514*b*, 516*b* of the waveguide branches 512, 514, 516. Accordingly, the first and second sides 510*a*, 510*b* of the waveguide 510 interface with each other to form the waveguide 510.

The configuration of the OMT 500 provides a compact structure and enables mounting of the radios 610, 620, 630 in close proximity to a reflector. According to an embodiment, the OMT 500 may be arranged in an antenna such that the first arm 502*b* and the second arm 502*c* lie within a substantially vertical plane, thereby positioning the first port 530 vertically above the second port 550 (or vice-versa), as shown in FIG. 6, with the first and second ports 530, 550 being substantially horizontally aligned. Such an arrangement provides the benefit of reducing potential interference of a mounting pole (e.g., pole 570 shown in FIG. 1) with the radios 610, 620, 630.

The OMT 500 may be fabricated by a method including casting the housing 502. According to an exemplary method, the first housing member 520 may be cast in a first mold and the second housing member 540 may be cast in a second mold. According to another alternate embodiment, the first and second housing members 520, 540 may be cast in the same mold. The first and second sides 510*a*, 510*b* of the waveguide 510 may be cast in the respective housing members 520, 540 by arranging one or more casting inserts in the mold(s). The one or more casting inserts may be arranged, sized and shaped as desired to produce the desired arrangement, size and shape of the first and second sides 510*a*, 510*b* of the waveguide 510. Accordingly, the operating frequency of OMTs 500 can be varied by using different casting inserts, while using the same housing mold(s). If the sides 510*a*, 510*b* of the waveguide 510 are cast from a non-conductive material, they may be coated with a conductive material after casting. After casting the housing members 520, 540, the housing members 520, 540 may be attached to each other such that the first and second sides 510*a*, 510*b* of the waveguide 510 are aligned with each other and interface with each other to form the waveguide 510.

The disclosed inventions provide OMTs that are efficient and cost-effective to manufacture. The disclosed methods of fabricating OMTs by casting OMT housings and waveguides enable OMTs of various operating frequencies to be produced without substantially changing the casting mold(s). Therefore, the cost of producing OMTs may be reduced, and the outer form (e.g., shape and size) of the OMT housings for OMTs of various frequencies may be substantially the same.

It should be understood that the devices and methods disclosed herein are merely exemplary embodiments of the invention. One of ordinary skill in the art will appreciate that changes and variations to the disclosed embodiments can be made without departing from the spirit and scope of the inventions as set forth in the appended claims.

We claim:

1. A communications system comprising an orthomode transducer, the transducer comprising:

a cast housing comprising first, second and third ports having respective first, second and third waveguide apertures lying in a plane, a first arm extending between said first and third ports in a first direction and a second arm extending between said second and third ports in a second different direction, and a central portion attached to the first arm and to the second arm and comprising the third port; and a cast waveguide within the housing, wherein the cast waveguide comprises a first waveguide branch, a second waveguide branch and a third waveguide branch forming a continuous open path connecting said first, second and third ports, said first waveguide branch coupled to the first waveguide aperture and configured to support transmission of signals having a first polarization, said second waveguide branch coupled to the second waveguide aperture and configured to support transmission of signals having a second polarization orthogonal to the first polarization, and said third waveguide branch coupled to the third waveguide aperture in the third plane, and coupled to the first waveguide branch and the second waveguide branch, wherein the third waveguide branch is configured to support transmission of signals having the first polarization and signals having the second polarization.

2. The system of claim 1, wherein the housing is constructed of one of the following materials: aluminum, magnesium, plastic and a polymer.

3. The system of claim 1 further comprising an antenna selected from at least the group consisting of a terrestrial microwave antenna and a very small aperture antenna.

4. A method of fabricating an orthomode transducer, comprising:

arranging a plurality of diagonally separated casting inserts in at least one mold;

casting a housing in the at least one mold comprising casting a first arm extending in a first direction and comprising a first port defining a first waveguide aperture insert, casting a second arm extending in a second different direction and comprising a second port defining a second waveguide aperture insert, and casting a central portion attached to the first arm and the second arm, and comprising a third port defining a third waveguide aperture insert; and casting a separate waveguide in each of the casting inserts comprising casting a first waveguide branch a second waveguide branch and a third waveguide branch forming a continuous open path connecting said first, second and third ports, said first waveguide branch coupled to the first waveguide aperture insert, and configured to support transmission of signals having a first polarization, said second waveguide branch, coupled to the second waveguide aperture insert and configured to support transmission of signals having a second polarization orthogonal to the first polarization, and said third waveguide branch coupled to the third waveguide aperture, and coupled to the first waveguide branch and the second waveguide branch, wherein the third waveguide branch is configured to support transmission of signals having the first polarization and signals having the second polarization, the first, second and third apertures lying in the same plane.

5. The method of claim 4, further comprising casting the housing from one of the following materials: aluminum, magnesium, plastic and a polymer.

6. A communications system comprising an orthomode transducer, the transducer comprising:

a cast comprising first, second and third ports having respective first, second and third waveguide apertures lying in a plane, a first arm extending between said first and third ports in a first direction and a second arm extending between said second and third ports in a second different direction, and a central portion attached to the first arm and to the second arm and comprising the third port; and a cast waveguide within the housing, wherein the cast waveguide comprises a first waveguide branch, a second waveguide branch and a third waveguide branch forming a continuous open path connecting said first, second and third ports, said first waveguide branch coupled to the first waveguide aperture insert and configured to support transmission of signals having a first polarization, said second waveguide branch, in a second plane that is substantially parallel to the first plane, coupled to the second waveguide aperture insert and configured to support transmission of signals having a second polarization orthogonal to the first polarization, and said third waveguide branch coupled to the third waveguide aperture insert, and coupled to the first waveguide branch and the second waveguide branch, wherein the third waveguide branch is configured to support transmission of signals having the first polarization and signals having the second polarization.

7. The system of claim 6 further comprising an antenna selected from at least the group consisting of a terrestrial microwave antenna and a very small aperture antenna.

8. An apparatus, comprising:

first and second housing member portions configured to form, when joined together, first and second waveguides configured to guide first and second orthogonal modes of a radio-frequency (RF) signal along respective first and second orthogonal paths, the first path running from a first waveguide aperture to a third waveguide aperture, and the second path running from a second waveguide aperture to the third waveguide aperture, the first and second paths each including at least one bend and lying entirely in a same plane.

9. The apparatus of claim 8, wherein said first and second housing member portions are cast.

10. The apparatus of claim 8, wherein a first line connecting said first waveguide aperture to said third waveguide aperture forms an acute angle with a second line connecting said second waveguide aperture to said third waveguide aperture.

11. The apparatus of claim 8, wherein said first waveguide is configured to propagate an RF signal having a first polarization of the RF signal, and said second waveguide is configured to propagate a second different polarization of the RF signal.

12. The apparatus of claim 8, wherein said second waveguide forms a right angle with said first waveguide and a point at which said first and second waveguides meet.

* * * * *